US005132032A

United States Patent [19]

Kavnatsky

[11] Patent Number: 5,132,032

[45] Date of Patent: * Jul. 21, 1992

[54] PAINT COMPATIBLE LUBRICANT COMPOSITION

[75] Inventor: Zara M. Kavnatsky, Farmington Hills, Mich.

[73] Assignee: Diversified Chemical Technologies, Inc., Detroit, Mich.

[ * ] Notice: The portion of the term of this patent subsequent to Jun. 4, 2008 has been disclaimed.

[21] Appl. No.: 663,463

[22] Filed: Mar. 4, 1991

Related U.S. Application Data

[63] Continuation-in-part of Ser. No. 444,324, Dec. 1, 1989, Pat. No. 5,021,172.

[51] Int. Cl.[5] ..... C10M 141/10

[52] U.S. Cl. ..... 252/32.7 E; 252/56 R; 252/33.3; 252/55; 252/52; 252/52 R

[58] Field of Search ..... 252/32.7 E, 33.6, 56 R, 252/33.3, 55, 52

[56] References Cited

U.S. PATENT DOCUMENTS 2,179,067 11/1939 Smith ..... 252/56 R
4,830,768 5/1989 Reich et al. ..... 252/56 R

FOREIGN PATENT DOCUMENTS 0182552 5/1986 European Pat. Off. ..... 252/56 R

*Primary Examiner*—Jacqueline Howard
*Attorney, Agent, or Firm*—Krass & Young

[57] ABSTRACT

A lubricant composition for use in metal-forming operations is compatible with aqueous-based paint baths and includes an oil having dissolved therein an ester derived from a $C_1$–$C_5$ alcohol and a $C_{10}$–$C_{25}$ acid. The ester is typically a methyl or ethyl ester and is present in weight concentrations of up to 30%. One specific pre-lubricant composition includes methyl oleate as the ester. The composition may further include corrosion inhibitors, antioxidants, lubricity builders and the like.

12 Claims, No Drawings

PAINT COMPATIBLE LUBRICANT COMPOSITION

RELATED APPLICATION

This is a continuation-in-part of U.S. application Ser. No. 07/444,324 filed Dec. 1, 1989 and entitled "Paint Compatible Pre-Lubricant" now U.S. Pat. No. 5,021,172.

FIELD OF THE INVENTION

This invention relates generally to lubricating compositions. More specifically, the present invention relates to a lubricants for use in metal forming operations, which lubricants will not contaminate aqueous based paint baths.

BACKGROUND OF THE INVENTION

A number of lubricants and/or protective oils are applied to metal stock in early stages of processing. These materials form an oily film on the stock which prevents corrosion during storage and handling, and lubricate the metal during subsequent stamping, drawing or other forming operations. Typical of such lubricant compositions are pre-lubricant oils, blanker oils and mill oil. Such lubricants are of particular utility in metal working operations involving steel and aluminum stock, but are also used in conjunction with other metals. Ideally, the lubricant material should be a good corrosion inhibitor and should have good film forming properties so that it can provide a continuous, oily, protective film on the metal stock during storage and handling. Furthermore, it should provide sufficient lubricity to facilitate the metal forming operations. Lubricant compositions of this type basically comprise an oil base together with corrosion inhibitors, film forming agents and similar ancillary ingredients.

If the formed metal parts are subsequently painted, plated or otherwise finished it is also desirable that the lubricant composition be readily removable so as to prevent interference of the oil base with finishing operations. Because of concerns relating to the cost, toxicity, flammability and the general undesirability of a number of organic solvents, manufacturers are turning increasingly to the use of aqueous based metal finishing processes. Heretofore employed organic based paint formulations are being replaced by aqueous compositions; and organic degreasing baths are being replaced with systems employing aqueous detergents for removing the lubricant.

In a typical finishing process, such as that employed in the manufacture of automobiles, a formed metal part is cleansed of lubricant material in a two-stage process. The first step is a prewash utilizing aqueous detergents, surfactants and the like. This is usually followed by one or more wash steps utilizing similar chemistry. Washing is typically carried out until water sheet, such draining being considered indicative of the lack of oil residue on the part. The washed part is then treated in an aqueous based, zinc phosphate containing bath. If oil residue is present on the part, the zinc phosphate coating will be thin, or absent, and later applied paint layers will form craters or other undesirable surface irregularities. Following the zinc phosphate treatment, the formed metal parts are primed, typically in an electrocoat primer bath.

As is well known to those of skill in the metal finishing arts, electrocoat primer paint is typically a water based composition including various proprietary resins, alcohols and the like. The parts are totally immersed in the bath and an electric field is established therethrough to facilitate the deposition of the paint coat on the part. Following the electrocoat step, a finish paint coat, typically comprised of one or more paint layers, is applied.

The lubricant material can cause several problems in such a process. As mentioned hereinabove, oily residue on the surface of the part can result in poor formation of a zinc phosphate coating and can subsequently cause irregularities in the electrocoat layer. Irregularities in these layers are manifested, and often magnified, in the final finish paint coat.

Although it is desirable to remove the entirety of lubricant residues from the part subsequent to final painting, this goal is frequently not achieved. While washing steps can remove residues from a large, relatively flat portion of the formed article, metal parts frequently include crevices, folds, seams and like configurations which can trap lubricant material preventing it from being removed in the washing steps. While traces of oil on such interior surfaces are not visible to the eye and hence do no significantly interfere with the quality of the final paint finish, their effects are actually far more serious than cosmetic.

Electrocoat baths are of necessity very large so as to accommodate automobile body panels and the like. These baths frequently contain 10,000 gallons or more of electrocoat paint. This paint is quite expensive and filling a single bath represents a very significant cost to a manufacturer. These baths are replenished as needed, but they are seldom drained because of the expense of raw materials and the undesirability of down time. Traces of lubricant composition trapped in crevices and the like may be leached out of formed articles during painting operations and can contaminate the electrocoat baths and/or finish paint baths. The contaminated bath will produce poorly painted parts and the finished items may manifest defects such as craters, fisheyes and various other irregularities in the final paint coat. Obviously, contamination of a large volume paint bath is an extremely costly accident which necessitates repainting of all of the articles produced in the bath as well as scrapping of the expensive bath.

It will be appreciated that there is a great need for lubricant compositions which are readily removed from formed metal parts by aqueous cleaning solutions; even more importantly, there are needed lubricant compositions which are compatible with various paint baths, and hence will not contaminate them if they are inadvertently introduced thereinto. The present invention provides for lubricant compositions which not only protect metal during handling and lubricate it during forming operations, but which are compatible with aqueous paint formulations. By "compatible" in the context of the present invention, is meant that contamination by traces of the lubricant composition does not adversely affect the function of the aqueous based paint baths. The lubricants of the present invention, although oil-based materials, disperse and/or solubilize into the electrocoat primer or other paint bath thereby preventing spoilage of the bath.

These and other advantages of the present invention will be readily apparent from the discussion, description, examples and claims which follow.

BRIEF DESCRIPTION OF THE INVENTION

There is disclosed herein a lubricant composition for use in metal forming operations. The lubricant is compatible with aqueous based paint formulations and comprises by weight approximately 10-30 percent of an ester produced by the reaction of a $C_1$-$C_5$ alcohol and a $C_{10}$-$C_{25}$ carboxylic acid together with approximately 1-20 percent of corrosion inhibitor and approximately 50-90 percent of an oil. In particular embodiments, the ester is a methyl ester. In one particular embodiment the ester is methyl oleate.

The corrosion inhibitor may include an alkali metal petroleum sulfonate such as sodium or calcium petroleum sulfonate. The corrosion inhibitor may also comprise an oxidized hydrocarbon wax. The pre-lubricant composition may further include other ingredients such as 0.5-0.2 percent of an anti-oxidant; 0.1-1 percent of zinc dialkyldithiophosphate and/or a plasticizer such as di-2-ethylhexyl adipate.

One particular class of pre-lubricant compositions structured in accord with the principles of the present invention is comprised, by weight, of approximately 0-6 percent of an oxidized hydrocarbon wax; approximately 10-30 percent of an ester obtained by the reaction of a $C_1$-$C_5$ alcohol and a $C_{10}$-$C_{25}$ carboxylic acid; 1-5 percent of sodium petroleum sulfonate; 0-5 percent of calcium petroleum sulfonate; 0.1-1 percent of zinc dialkyldithiophosphate; 0.5-2 percent of an anti-oxidant and the balance napthenic oil. Another class of lubricants prepared in accord with the present invention comprise blanker oil formulations. These materials employ a light oil base such as mineral seal oil.

DETAILED DESCRIPTION OF THE INVENTION

The present invention is directed to oil-based lubricant compositions which are compatible with aqueous based paint baths such as primer baths, electrocoat primer baths and finish paint. The compositions include an ester of the type which may be produced by the reaction of a $C_1$-$C_5$ alcohol and a $C_{10}$-$C_{25}$ carboxylic acid. It has been found in accord with the principles of the present invention that inclusion of an ester of this particular class provides for compatibility of the lubricant composition with the aqueous paint bath. As noted hereinabove, traces of a compatible lubricant will not adversely contaminate a paint bath so as to degrade the bath and/or cause defects in articles painted therein.

The exact mode of operation of the ester in providing paint compatibility is not specifically understood. Esters of this general class are fairly long molecules having a hydrophobic "tail" comprised of the hydrocarbon chain of the fatty acid and a hydrophilic "head" comprised of the ester linkage. It is suspected that the dual affinities of these ester molecules aid in dispersing, emulsifying, sequestering or otherwise promoting the interaction of traces of oil contaminant with the paint so as to negate any adverse affects therefrom. It has also been found that further ingredients such as corrosion inhibitors, antioxidants, plasticizers and the like may also be included in the lubricant compositions. Presence of these additional ingredients further enhances the beneficial properties of the lubricants without detracting from their compatibility with aqueous formulations.

The Ester

There are a variety of esters which may be utilized in accord with the principles of the present invention and one of skill in the art could, in light of the teaching herein, select an ester appropriate for a given set of conditions. The ester should be compatible with the particular oil base of the lubricant and should be sufficiently polar to interact with the oil and water as mentioned hereinabove. The ester should not interfere with metal forming operations and hence should not detract significantly from the lubricity of the composition. In fact, particular esters can impart further lubricity. Additional factors to be considered in the selection of an ester will obviously be the cost, availability and stability of the ester. It has been found that methyl esters of fatty acids comprise one class of materials having particular utility in the practice of the present invention and they are generally available for a variety of organic acids. Ethyl esters have many properties similar to methyl esters and may also be similarly employed.

The esters of the present invention may be prepared from a wide variety of organic acids. The prime considerations in the selection of an acid will be its effects on the melting point, vapor pressure, polarity, solubility and lubricity of the resultant ester. In general, it has been found that $C_{10}$-$C_{25}$ acids, both saturated and unsaturated, are well suited for use in the preparation of esters having utility in the present invention. Some acids having particular utility are oleic acid, nondecylic acid, stearic acid, margaric acid, palmitic acid, linoleic acid, linolenic acid as well as various other saturated and unsaturated acids. Table 1 sets forth some esters representative of those having significant utility in the invention. The table lists the chemical name of the ester, its molecular weight, melting point and boiling point. Where the boiling point was determined at a pressure other than atmospheric, that pressure is indicated in parenthesis. All of the esters listed are insoluble in water.

TABLE 1

| Ester | M.W. | Melting Point °C. | Boiling Point °C. |
|---|---|---|---|
| Methyl decanoate | 186.3 | | 224 |
| Propyl decanoate | 214.35 | | 128.5(10) |
| Methyl laurate | 214.34 | | 262 |
| Ethyl laurate | 228.36 | | 273 |
| Isopropyl laurate | 242.39 | | 117.4(2) |
| Propyl laurate | 242.39 | | 123.7(2) |
| Methyl oleate | 296.5 | 19.9 | 216.7(20) |
| Ethyl oleate | 310.52 | | 216.7(15) |
| Methyl stearate | 298.5 | 39 | 215(15) |
| Ethyl stearate | 312.5 | 33.9 | 213-5(15) |
| Isobutyl stearate | 340.59 | 25 | 223(15) |
| Methyl margarate | 298.51 | 28 | 185(5) |
| Ethyl margarate | 284.49 | 30 | 184-7(9) |
| Methyl eicosonoate | 326.55 | 54 | 215-6(10) |
| Ethyl eicosonoate | 340.58 | 49-50 | 186(7) |
| Methyl linoleate | 294.48 | | 211-2(16) |
| Ethyl linoleate | 308.5 | | 270-5(180) |
| Ethyl linoleate | 306.49 | | 132-3(.1) |
| Methyl palmitate | 270.46 | 30 | 415-8(747) |
| Ethyl palmitate | 284.49 | 25 | 191(10) |
| Butyl palmitate | 312.54 | 16 | |

One particularly preferred ester is methyl oleate. This ester is commercially available in plentiful supply and at a relatively low cost. It functions quite well to promote the compatibility of lubricating compositions with aqueous paint baths and it manifests good lubricating properties in and of itself. One particular grade of methyl oleate having utility in the present invention is sold by the Keil Chemical Division of the Ferro Corporation of Hammond, Ind. This material is provided as a white to yellow, low viscosity liquid. It is sparingly soluble in water (less than 0.2%), and it has a specific gravity of approximately 0.88 at 25° C. Ethyl oleate has very similar properties and manifests the same utility. Methyl and ethyl stearate, palmitate and margarate esters are also quite similar in physical and chemical properties to the oleates and to one another and may also be used interchangeably in many instances.

It is generally preferred that the ester be present at approximately 10–30 percent by weight with higher molecular weight esters being used at the higher end of the range and lower molecular weight esters at the lower end of the range. It has been found that when the amount of ester is decreased much below approximately 10 percent, the compatibility of the composition with paint baths is decreased. The use of the ester in amounts greater than thirty percent tends to decrease the corrosion protection afforded by the lubricant.

When methyl oleate (MW 296.5) is as the ester, it has been found most advantageous to employ it at an approximately twenty percent by weight concentration. It has been found that similar optimum compositional ranges apply to the other esters and one of skill in the art could readily determine an appropriate amount of ester by balancing compatibility and corrosion protection factors.

Corrosion Inhibitors

In addition to the ester components, the lubricant compositions of the present invention also include approximately 1–20 percent of corrosion inhibitors. These compositions, as their name implies, operate to prevent rusting or other corrosion of the metal. There are a wide variety of corrosion inhibitors known and available to those of skill in the art and these materials may be used in various combinations in the present invention.

One class of corrosion inhibitors having utility in the present invention are the organic corrosion inhibitors; and, the Group I and Group II metal salts of petroleum sulfonates are a group of organic corrosion inhibitors particularly useful in the invention. These materials are generally viscous, oily liquids, which are soluble in hydrocarbons and which, in some instances, are emulsifiable in water. The sulfonates aid in preventing rusting or other corrosion of the metals and some degree, enhance the lubricity of the composition.

Sodium petroleum sulfonate is typical of one such material. It is characterized as a brown, viscous fluid with a slight petroleum odor and a low vapor pressure (less than one millimeter Hg at 70° F). It has a specific gravity slightly greater than water, is soluble in hydrocarbons and emulsifiable in water. Sodium petroleum sulfonate is available from a number of chemical suppliers and one grade suitable for use in the present invention is the product sold under the trade name of "Petrosul H-60 Sod Sulfonate" by the Penreco Corporation of Butler, Pa., which is a division of the Penzoil Product Company.

Another similar corrosion inhibitor is calcium petroleum sulfonate. It has corrosion inhibiting properties similar to sodium petroleum sulfonate, but further acts to improve the humidity resistance of coated articles. Calcium petroleum sulfonate is generally described as being "overbased calcium sulfonate in refined petroleum oil." The material is a viscous oil having a low vapor pressure (less than 50 millimeters Hg at 70° F). It has a specific gravity of slightly less than one at 70° F. and is sparingly soluble in water. Calcium petroleum sulfonate is available from a number of chemical suppliers and one grade having utility in the present invention is sold under the trade name of "Calcium Petronate 25 C" by the Sonneborn Division of the Witco Chemical Co. located in Petrolia, Pa.

Another group of corrosion inhibitors comprises the salts of organic acids, most preferably $C_{10}$ to $C_{18}$ acids. Such materials enhance corrosion resistance and water displacing properties of the lubricant. Once such material is sold under the trade name "Hostacor E" by the Hoechst Celanese Corporation and comprises a brown, clear liquid with a specific gravity of approximately 1.

There are a variety of other corrosion inhibitors which may be utilized in addition to, or instead of, the foregoing materials. Various oxidized hydrocarbons are one such group of compounds having utility as corrosion inhibitors. Ideas, Inc. of Wood Dale, Ill. sells a corrosion inhibitor under the trade name "Ida-Soil D-906." This material is characterized as an oxidized hydrocarbon wax and is supplied as a dark amber solid and it provides corrosion protection to metal parts in acid atmospheres. A similar product sold by the same company under the trade name "Ida-Soil D-903" has similar properties.

Other types of corrosion inhibitors may be similarly employed. For example, the Alox Corporation of Niagara Falls, N.Y. sells a number of rust inhibitors under the trade name of "Aqualox". These materials are broadly described as amine salts of carboxylic acids in which the oxygenated hydrocarbon portion of the acid can be either aliphatic or aromatic. Various other corrosion inhibitors are known and may be similarly employed.

The Oil

There are a variety of oils which may be used in formulating the lubricants of the present invention. The choice of oil will depend primarily upon the application, and desired characteristics, of the resultant lubricant formulation. Blanker oils are typically of fairly low viscosity and thin, relatively light oils will be used in blanker oil formulations whereas pre-lubricants generally require heavier, more viscous oils.

In the formulation of blanker oils, it has been found that those oils termed in the art "mineral seal" oil are generally preferred. This designation refers to mineral oils of medium to light viscosity, similar in properties to oils historically derived from seals. One grade of mineral seal oil having utility in the present invention is a product sold under the name of "Grade 45 Oil" by the Sterling Oil and Chemical Company of Southfield, Mich. This oil has a specific gravity of approximately 31.2–31.7 at 60° F., a viscosity SUS of 44–50 at 100° F. and 31–32 at 210° F., a viscosity index of 50–80, a pour point of 15°–35° F. and when distilled, manifested an initial boiling point of 466°–518° F.; 10% distillation at 546°–566° F.; 50% distillation at 596°–608° F.; 90% distillation at 650°–662° F. and a final boiling point of 686°–692° F. Analysis indicates that this oil typically comprises 25% aromatics and 75% saturates.

A heavier oil having utility in the formulation of pre-lubricants or mill oil compositions comprises a napthenic base oil sold under the trade name of "100 SUS Napthenic" by the Eppert Oil Company of Detroit, Mich.

Other Ingredients:

The lubricants of the present invention may further include stabilizers, lubricity builders, viscosity control agents, plasticizers and other such ancillary ingredients as are well known to those of skill in the art. For example, particular lubricants may include zinc dialkyldithiophosphate. This material serves to boost the lubricating ability of various oil compositions, particularly under high pressure conditions. Zinc dialkyldithiophosphate is available from a variety of suppliers and one such composition is sold under the registered trademark "Lubrizol 677A" by the Lubrizol Corporation of Wickliffe, Ohio. This material is an oil-based solution of zinc dialkyldithiophosphate which contains approximately 8.3 to 8.7 percent phosphorus, 17.0 to 18.2 percent sulfur and 8.85 to 10 percent zinc.

The lubricant compositions may also include antioxidant compounds such as di-t-butyl cresol and the like. Such materials increase the humidity resistance of metals protected by the composition. One such antioxidant is sold by the Lubrizol Corporation under the trade name "Lubrizol 817" and is provided as a white powder, insoluble in water, and having a specific gravity of approximately 1.05 at 20° C.

It has been found that the addition of various plasticizers and thickeners serves to build a smoother film of the pre-lubricant material. One particular plasticizer having utility in the present invention is di-2-ethylhexyl adipate. This material is sold under the registered trademark "Plasthall" by the C. P. Hall Company of Chicago, Ill.

The addition of a surfactant has been found to improve the acid atmosphere corrosion resistance protection afforded by the lubricants. Oxazoline type surfactants are one group of materials having utility in the present invention. One commercially available oxazoline surfactant is supplied by the Angus Chemical Company of Northbrook, Ill. under the trade name "Alkaterge T-IV." It is a dark brown liquid having an approximate molecular weight of 545.

It has also been found that the addition of relatively small amounts (i.e. 0.5-1.5%) of free fatty acids can enhance the clarity of the pre-lubricant composition. For example, addition of about 0.5% of oleic acid seems to facilitate solubilization of the ingredients of the lubricants.

The following examples detail the preparation of particular lubricant compositions of the present invention.

EXAMPLE 1

One particular pre-lubricant composition was prepared by melting 56 grams of oxidized hydrocarbon wax ("Idasoil D906") and 24 grams of sodium petroleum sulfonate ("Petrosul H-60 Sod Sulfonate"), at approximately 150° F. until a homogeneous solution was obtained. To this mixture was added 200 grams of methyl oleate (Keil Chemical), 20 grams of calcium petroleum sulfonate, ("Calcium Petronate 25c") 5 grams of zinc dialkyldithiophosphate ("Lubrizol 677A") and 1 gram of di-2-butyl cresol ("Lubrizol 817"). The mixture was stirred to provide a homogeneous solution and 682 grams of napthenic oil ("100 SUS Viscosity Napthenic") was then added. Then, 12 grams of oleic acid was added and stirring was continued until a homogeneous solution was obtained.

The thus prepared pre-lubricant material was applied to a number of steel test panels. These pieces were exposed to relative humidities of 100% at temperatures of 100° F. for periods of time up to 3 days and no evidence of rusting was noted. The thus treated metal panels were subsequently washed in a phosphate based detergent at 150° F., rinsed, rewashed, rerinsed and treated in a zinc phosphate bath and painted in an electrocoat primer bath. The primed pieces, which exhibited a uniformly coated surface, were subsequently painted with an aqueous based, high solids automotive paint. The finish coat was smooth, uniform and exhibited no cratering, fisheyes or other such defects.

The compatibility of the pre-lubricant with electrocoat baths was assessed by adding approximately 5 milliliters of the foregoing composition to 1 liter of electrocoat primer. The mixture was stirred for 12 hours and cleaned, non pre-lubricated steel samples were electrocoated with the primer. The primed steel exhibited a smooth surface, free of defects. Application of a finish coat to the primed samples yielded a defect free surface.

EXAMPLE 2

A composition similar to the foregoing was prepared except that the methyl oleate was eliminated and the amount of napthenic oil increased to 882 grams. The composition was applied to steel plates as in the foregoing example. The lubricated metal plates exhibited no corrosion after being stored at 100° F. and 100% relative humidity for up to 3 days. The coated samples were washed, as in the foregoing example, and treated in a zinc phosphate bath and painted in an electrocoat primer bath. The primed sheets manifested some cratering defects. Application of the high solids finish paint thereto provided a surface finish characterized by a number of crater-type defects approximating 6-10 per 24 square inches.

The compatibility of the pre-lubricant with primer and electrocoat baths was assessed by adding approximately 5 milliliters of the composition to 1 liter of electrocoat primer. The mixture was stirred for 12 hours and cleaned, non pre-lubricated steel samples were electrocoated with the primer. The primer coat on the steel samples was somewhat uneven and included a number of crater defects. Application of a finish paint coat to the primed samples yielded a finish having approximately 5-10 craters per 24 square inches.

EXAMPLE 3

A blanker oil composition was prepared by melting 56 grams of oxidized hydrocarbon wax ("Idasoil D906") and 24 grams of sodium petroleum sulfonate ("Petrosul H-60 Sod Sulfonate") at approximately 150° F. until a homogeneous solution was obtained. To this mixture was added 200 grams of methyl oleate (Keil chemical), one gram of Di-2-butyl cresol ("Lubrizol 817") and 5 grams of oxazoline-type surfactant ("Alkaterge ® T-IV") and 1 gram of an organic acid salt corrosion inhibitor ("Hostacor E"). The mixture was stirred to provide a homogeneous solution and 680 grams of mineral seal oil ("Grade 45 oil" Sterling Oil and Chemical Company) was added. The resultant mixture was stirred until a uniform solution obtained and at this point 13 grams of oleic acid was added and the stirring continued until a homogeneous solution obtained.

The thus prepared blanker oil was applied to a number of steel test panels. These pieces were exposed to relative humidities of 100% at temperatures of 100° F. for periods of time up to three days and no evidence of rusting was noted. The thus treated metal panels were subsequently washed in a phosphate-based detergent at 150° F., rinsed, rewashed, rerinsed and treated in a zinc phosphate bath painted in an electrocoat primer bath. The primed pieces, which exhibited a uniformly coated surface, were subsequently painted with an aqueous based high solids automotive paint. The finish coat was smooth, uniform and exhibited no cratering, fish eyes or other such defects.

The compatibility of the blanker oil with the electrocoat bath was assessed by adding approximately 5 milliliters of the foregoing blanker oil composition to one liter of electrocoat primer. The mixture was stirred for 12 hours and cleaned, non-pre-lubricated steel samples were electrocoated with the primer. The primed steel exhibited a smooth surface, free of defects an application of a finish coat atop the primed samples yielded a defect free surface.

EXAMPLE 4

A pre-lubricant composition was prepared generally similar to that of Example 1 except that 200 grams of ethyl oleate was substituted for the methyl oleate. This pre-lubricant was also found to be compatible with electrocoat baths when assessed as in the foregoing examples. It was also found that steel samples lubricated with the material of this example and subsequently washed provided a defect free surface when painted.

EXAMPLE 5

A blanker oil generally similar to that of Example 3 was prepared except that 300 grams of methyl stearate was substituted for the methyl oleate. The blanker oil thus produced gave results similar to that of the material of Example 3 with regard to surface quality and electrocoat primer compatibility.

EXAMPLE 6

A blanker oil generally similar to that of Example 3 was prepared except that 150 grams of methyl laurate was substituted for the methyl oleate. This blanker oil gave results similar to that of the composition of Example 3 with regard to surface quality and compatibility with electrocoat primer.

In general, it has been found that there is very wide range of compositions which may be prepared in accord with the principles of the present invention. There are a number of esters obtained by the reaction of $C_1$–$C_5$ alcohol with a $C_{10}$–$C_{25}$ acid and these materials have utility in the present invention. An illustrative grouping of these materials is set forth in Table 1. In general, incorporation, by weight, of approximately 10–30% of the ester into a lubricant composition will strike an acceptable balance between paint bath compatibility and rust protection. A general composition will typically include 10–30% of the ester, 1–20% of corrosion inhibitor and 50–90% of a lubricant oil.

A more specific composition for a pre-lubricant in accord with the principles of the present invention comprises by weight between 0 and 6% of an oxidized hydrocarbon wax; 10–30% of the ester; approximately 1–6% of sodium petroleum sulfonate; approximately 0–6% of calcium sulfonate; approximately 0.1–1% of zinc dialkyldithiophosphate; approximately 1.3% of oleic acid; and approximately 0.05–0.2% of an antioxidant.

A more specific formulation for blanker oil in accord with the principles of the present invention comprises by weight between 0 and 6% of an oxidized hydrocarbon wax; 10–30% of the ester; approximately 1–6% of sodium petroleum sulfonate; approximately 0.05–0.2% of an antioxidant and approximately 0.5–1.5% of oleic acid.

It will be appreciated that by following these general guidelines, a great variety of lubricant compositions may be prepared in accord with the principles of the present invention. Accordingly, the foregoing discussion, description and examples are merely illustrative of particular embodiments of the present invention and are not limitations upon the practice thereof. It is the following claims, including all equivalents, which define the scope of the invention.

I claim:

1. A lubricant for use in metal forming operations, which is compatible with aqueous based paint formulations, said lubricant comprising by weight:

0–6% of an oxidized hydrocarbon wax;
10–30% of an ester prepared by the reaction of a $C_1$–$C_5$ alcohol and a $C_{10}$–$C_{25}$ carboxylic acid;
1–5% of sodium petroleum sulfonate;
0–5% of calcium petroleum sulfonate;
0–0.5% of di-2-t-butyl cresol;
0.1–0.5% of an oxazoline type surfactant;
0–0.5% of a salt of a $C_{10}$–$C_{18}$ acid;
0.5–1.5% oleic acid; and the balance, mineral seal oil.

2. A lubricant as in claim 1, further including a di-2-ethylhexyl adipate containing plasticizer.

3. A lubricant composition as in claim 1, further including approximately 0.5–1.5% by weight of a $C_{10}$–$C_{25}$ free fatty acid.

4. A lubricant composition as in claim 1, further including approximately 0.05–0.0% by weight of a salt of a $C_{10}$–$C_{18}$ acid.

5. A lubricant as in claim 1, further including approximately 0.05–0.2% by weight of an antioxidant.

6. A lubricant as in claim 1, further including approximately 0.1–1% by weight of zinc dialkyldithiophosphate.

7. A lubricant composition as in claim 1, wherein said oil is mineral seal oil and has:

a specific gravity of 31.2–31.7 at 60° F.;
a viscosity (SUS) of 44–50 at 100° F.;
a viscosity (SUS) of 31–32 at 210° F.; and
a pour point of approximately 15°–35° F.

8. A lubricant composition for use in metal forming operations, which is compatible with aqueous based paint formulations, said lubricant comprising by weight:

0–6% of an oxidized hydrocarbon wax;
10–30% of an ester prepared by the reaction of a $C_1$–$C_5$ alcohol and a $C_{10}$–$C_{25}$ carboxylic acid;
1–5% of sodium petroleum sulfonate;
0–5% of calcium petroleum sulfonate;
0.1–1% of zinc dialkyldithiophosphate;
0.05–2% of an antioxidant;
0.5–1.5% of oleic acid; and
the balance, napthenic oil.

9. A lubricant as in claim 8, wherein said ester comprises methyl oleate and said ester is present in a concentration no greater than 20%.

10. A lubricant composition as in claim 8, further including approximately 0.05-0.5% by weight of a salt of a $C_{10}$-$C_{18}$ acid.

11. A lubricant as in claim 8, further including a di-2-ethylhexyl adipate containing plasticizer.

12. A lubricant composition as in claim 8, further including approximately 0.5-1.5% by weight of a $C_{10}$-$C_{25}$ free fatty acid.

* * * * *

UNITED STATES PATENT AND TRADEMARK OFFICE

CERTIFICATE OF CORRECTION

PATENT NO. : 5,132,032
DATED : 7/21/92
INVENTOR(S) : Zara M. Kavnatsky

It is certified that error appears in the above-identified patent and that said Letters Patent is hereby corrected as shown below:

Column 10, Line 41 Delete " "0.05-0.0%" insert --0.05-.5%".

Signed and Sealed this

Fourteenth Day of September, 1993

*Attest:*

*Attesting Officer*

BRUCE LEHMAN

*Commissioner of Patents and Trademarks*